United States Patent [19]

Summer

[11] Patent Number: 4,768,246

[45] Date of Patent: Sep. 6, 1988

[54] APERTURED ORTHOPEDIC HEAD PILLOW

[76] Inventor: John D. Summer, 1427 NW. 23rd, Portland, Oreg. 97210-2615

[21] Appl. No.: 64,230

[22] Filed: Jun. 17, 1987

[51] Int. Cl.[4] ..... A47C 20/02

[52] U.S. Cl. ..... 5/434; 5/436; 5/437

[58] Field of Search ..... 5/446, 434, 437, 442

[56] References Cited

U.S. PATENT DOCUMENTS

| | | | |
|---|---|---|---|
| 2,700,779 | 9/1952 | Tolkowsky . | |
| 2,940,087 | 2/1957 | Kiefer . | |
| 2,940,088 | 2/1959 | Boos . | |
| 3,118,152 | 1/1964 | Talley, Jr. | 5/436 X |
| 3,139,631 | 7/1964 | Kiefer . | |
| 3,400,413 | 9/1968 | La Grossa | 5/436 |
| 3,694,831 | 10/1972 | Treace . | |
| 3,753,264 | 8/1973 | Grenier . | |
| 3,848,281 | 11/1974 | Mathews . | |
| 3,981,032 | 9/1976 | Brooks . | |
| 3,987,507 | 10/1976 | Hall . | |
| 4,017,118 | 4/1977 | Cawley . | |
| 4,259,757 | 4/1981 | Watson . | |
| 4,375,112 | 3/1983 | Leonhart | 5/436 |
| 4,617,691 | 10/1986 | Monti et al. | 5/434 |

*Primary Examiner*—Michael F. Trettel
*Attorney, Agent, or Firm*—Klarquist, Sparkman, Campbell, Leigh & Whinston

[57] ABSTRACT

In an orthopedic pillow in accordance with the present invention comprises a unitary body of foam or other resilient material with a deep generally hemispherical depression or aperture. The aperture receives the back of a user's head in such a manner that a portion of the weight of the head is supported directly by a mattress or the like beneath the pillow while the rest of the weight of the user's head is supported by the surrounding portion of the pillow. This design allows the user's head to rest generally on the same horizontal surface on which the remainder of the user's body rests. As a result, the head can shift backwardly into an ideal postural position in relation to the long axis of the user's body. In addition to holding the head, the pillow cushions the head by distributing its weight over a wide area. Also, the aperture is eccentrically positioned in the body to provide different distances between the edge of the body and the aperture. By orienting the pillow appropriately, it can be positioned to fit users with different neck lengths. Also, in one form of the invention, the size of the aperture is adjustable to fit various sized heads.

12 Claims, 1 Drawing Sheet

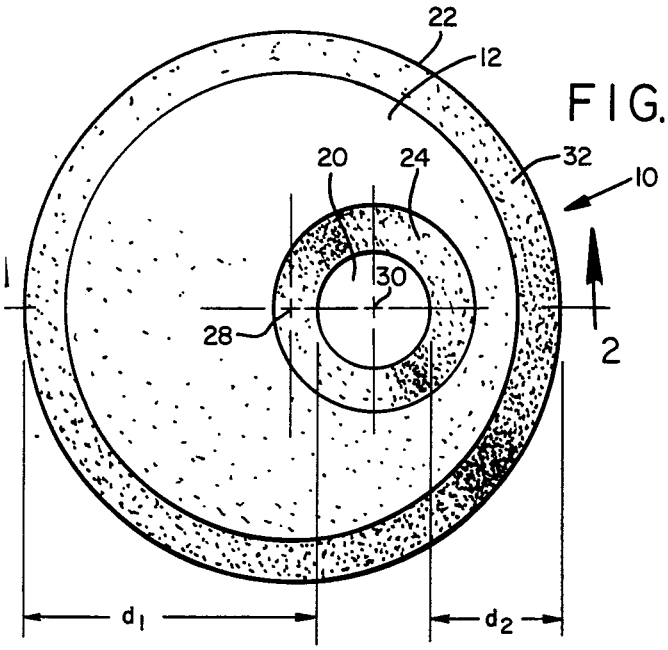
FIG. 1
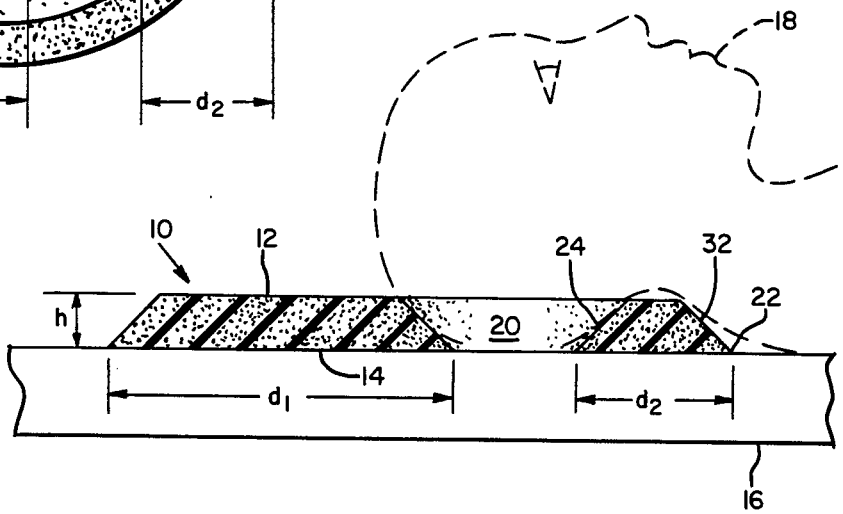
FIG. 2
FIG. 3
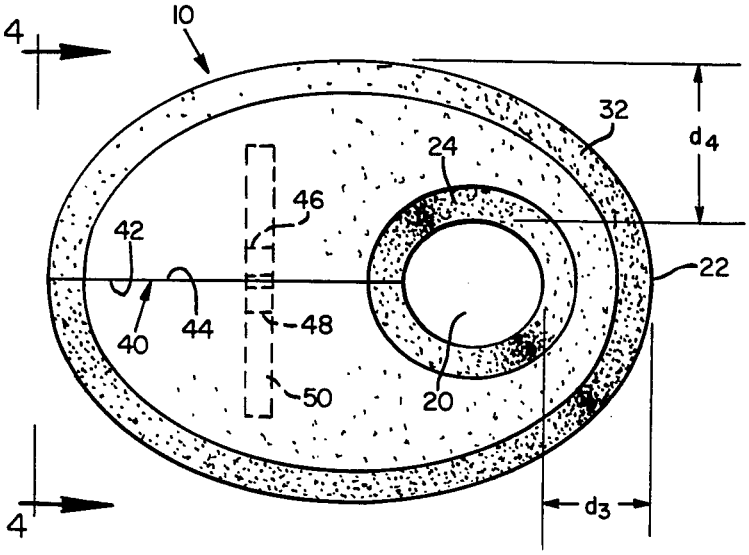
FIG. 4
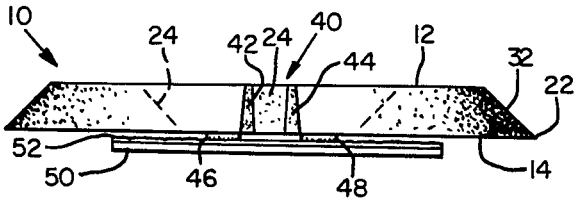

APERTURED ORTHOPEDIC HEAD PILLOW

BACKGROUND OF THE INVENTION

1. Field of the Invention

The present invention relates to orthopedic pillows and more particularly to pillows designed to treat the common problem of forward head posture. The design of the present invention is based on the principle that the health of the spinal system is enhanced by sleeping on our backs with our heads in a fully retruded position in relation to the long axis of our bodies, as if no pillow is used.

2. Description of the Prior Art

In our culture people typically place something soft under their heads while sleeping in order to spread out the weight of the head and thereby provide comfort and reduce the ischemia which results when the weight of the head is concentrated on a small surface area. Yet, when a person sleeps on his or her back, cushions placed directly under the head prop the head up so that it rests on a horizontal plane which is higher (farther from the ground) than the plane on which the body rests (usually the mattress). This arrangement may be comfortable because no ischemia is produced locally on tissues, yet it may contribute to the postural strain in the spine which has become almost endemic in our society.

It is widely agreed that conditions producing back pain and chronic discomfort take an enormous toll on our society in terms of man-hours lost from work and symptomatic medical treatment aimed at providing temporary relief. It is also widely agreed that the body posture during sleep is important in both etiology and treatment for this condition. Thus, it is not surprising that an orthopedically designed alternative to the traditional pillow has become necessary.

As we have studied the postural systems of those suffering from back pain, an almost constant finding has been forward head posture. A vertical axis through the head rests farther in front of a vertical axis through the body than is found in healthy subjects. As the head is shifted forward the forward facing convex curve of the neck beneath it (called the cervical lordosis) is lost. Forward head posture while standing forces the entire spine to strain in order to balance the head on its top section. This is because the spinal column must align its weight bearing surfaces directly underneath the head in order to effectively provide vertical support. Forward head posture results immediately in increased resting electrical activity (or tonus) in the muscles of the back. This arises because, as the head shifts forward, it drags the shoulder girdle with it, and the muscles running up and down the back of the spine are forced to operate at longer resting lengths as their attachments shift slightly further away from each other. Frequently these muscles have a difficult time adapting, especially when blood flow to the area is already compromised by strain or injury. These muscles are required to hold the heavy head out in front of them rather than directly over the spinal column which is designed to accept forces directed straight down on it. Thus, a head which is postured back over the shoulders and spinal column is preferred to a head postured forward over a person's sternum.

Traditional pillows add to the problem of forward head posture. This happens because, while the user is lying on his or her back, they prop the head vertically above the surface of the mattress. As a result the head is maintained in a forward position relative to the long axis of the body.

One known alternative is the contoured pillow designed to anatomically mirror the healthy cervical column. These pillows feature a convexity positioned in the middle of the back of the neck and which is designed to reestablish the lordosis which should be there. Yet it is the positioning of the top of the cervical column too far forward, not the positioning of the middle of the cervical column too far back, which causes the orthopedic problem in the first place. The contoured pillow does not address this problem as it still props the head forward off the mattress. Furthermore, the body's need to keep its airway open will prevent any lordosis from occurring by the cervical spine moving forward into the space normally reserved for air passage.

Another known alternative to the traditional head pillow has been the cervical pillow. Such a pillow also attempts to push a lordosis into the back of the cervical column. This may become unbearable if it threatens to impinge on a person's airway, but it has the important advantage of allowing the head to rest all the way back on the same plane as the rest of the body. Thus, orthopedically such pillows may be helpful. However, the trouble with cervical pillows is that they are not comfortable because they do not support the head in a way which distributes its weight widely to prevent ischemia beneath weight bearing surface areas of the head. The weight of the head rests only on the occipital (rear) section of the skull and the upper cervical column (which is particularly ill suited for bearing weight because of the extensive venous drainage in the area).

Other alternative pillows have been designed for use by a person sleeping on his or her side. Such pillows provide a therapeutic postural position of the head by placing the proper thickness of material between the side of the head and the mattress. However, many specialists in the field of spinal orthopedics agree that sleeping on the back is healthier than sleeping on the side, and sleeping on the stomach is the worst of all.

The ideal head posture during sleeping is therefore achieved when no pillow at all is used and the head is allowed to shift backward until its occipital portion rests on the mattress. This allows the head to retrude in relation to the long axis of the spine and thereby produces, at least while sleeping, a correct head posture rather than a forward head posture. The only problem commonly encountered when no pillow is used under the head is that the entire weight of the head rests on a small area of the back of the head. As a result, this area may become ischemic and uncomfortable due to the pressure of nine to fourteen pounds resting on it. The point of a pillow is to cushion the head so that it can rest comfortably.

Therefore, a need exists for an improved orthopedic pillow directed towards overcoming these and other problems of the prior art.

SUMMARY OF THE INVENTION

Accordingly, it is one object of the present invention to provide an improved orthopedic head pillow which will encourage the user to sleep on his or her back with the occipital area of the head generally in contact with the same surface on which the other bony areas of the user's body (i.e. back, shoulders, hips, etc.) rest, thus promoting improved head posture and its attendant health benefits.

Another object of the invention is to provide such a pillow which supports the head by evenly distributing its weight widely about the entire occipital portion of the skull, avoiding excessive contact pressure in any one area so as to maximize comfort and satisfactory blood flow to all areas of the head.

Still another object of the present invention is to provide such a pillow which is capable of fitting users with necks of various lengths and heads of various sizes.

A further object of the present invention is to provide a pillow which is comfortable and which can be manufactured in a cost effective manner.

In furtherance of these and other objects of the present invention, an improved orthopedic pillow is described with a body of a resilient material, such as a self-skinning polyurethane foam, with an upper surface and a base surface for resting on a mattress or other support surface for a user of the pillow. The pillow body has a peripheral edge or boundary and an interior wall surface which defines a generally hemispherical head receiving aperture or depression spaced from the peripheral edge. The aperture permits the back of the user's head to rest substantially in the plane of the mattress or other support surface. Also, the wall surface bounding the aperture supports the sides of the user's head so as to distribute the weight of the head and cushion the head during use. Such a pillow allows the head to be positioned in a fully retruded position in relation to the long axis of the body so as to orthopedically treat the problem of forward head posture.

As another feature of the invention, the aperture is eccentrically positioned at a location within the body so as to provide differing distances from locations along the peripheral edge of the pillow to the aperture. By appropriately rotating or orienting the pillow, a user can select the distance between the peripheral edge and aperture which more closely conforms to the length of the user's neck.

The body may take a variety of shapes, including circular or ellipical. In addition, the body may have a trapezoidal-shaped vertical cross section with the aperture being generally an inverted trapezoid in vertical cross section.

As an optional feature of the invention, a means is provided for adjusting the size of the aperture to accommodate heads of varying dimensions. In one illustrated form, such means comprises a slit extending from the periphery of the pillow to the aperture and bounded by first and second slit bounding walls. By spreading apart or drawing together the slit bounding walls, the aperture is respectively enlarged or decreased in size.

A retaining means is also provided for selectively holding the slit bonding walls in a desired position of adjustment. The illustrated retaining mechanism comprises hook and eye fabric patches on the base surface of the body which are positioned adjacent to the respective slit bounding walls. A spreader has hook and eye fabric for selectively engaging the patches to hold the slit bounding walls at the desired spacing from one another and thereby establish the size of the head receiving aperture.

These and other features, objects and advantages of the present invention will become apparent with reference to the following description and drawings.

BRIEF DESCRIPTION OF THE DRAWINGS

FIG. 1 is a top plan view of an improved orthopedic pillow in accordance with the present invention;

FIG. 2 is a cross sectional view of the pillow of FIG. 1, taken along lines 2—2 thereof, and also showing a person in dashed lines lying on a mattress and using the pillow;

FIG. 3 is a top plan view of an alternate embodiment of a pillow in accordance with the present invention; and FIG. 4 is an end elevational view of the pillow of FIG. 3, taken generally in the direction of lines 4—4 thereof, and showing the slit bounding walls spread apart somewhat from one another.

DETAILED DESCRIPTION OF PREFERRED EMBODIMENTS

Referring to FIGS. 1 and 2, one form of improved orthopedic pillow in accordance with the present invention includes a body 10 with an upper surface 12 and a lower or base surface 14. Base surface 14 is typically planar for resting on the upper surface of a mattress or other support 16, as shown in FIG. 2. As shown in this figure, the base surface 14 is also generally in the same plane as the bottom of the occipital region of a user's head 18 and the other bony regions (such as the shoulder, back and hips) of the user when lying on his or her back on the mattress. To permit this positioning of the user's head, an aperture or depression 20 extends between the upper surface 12 and the base surface 14. This aperture is spaced from the peripheral edge 22 of the body. In addition, the aperture is bounded by an interior wall 24 such that the aperture 20 is generally hemispherical in shape.

In the FIG. 1 form of the invention, the body 10 is generally of a circular form with a center as indicated at 28. The aperture 20 is also generally circular in dimension, but has its center 30 spaced from the center 28 of the body. This eccentric or off centered positioning of the aperture enables the pillow to comfortably be used by individuals with necks of varying lengths. That is, by merely rotating the pillow, a user can orient the pillow so as to comfortably support the user's neck whether the user has a short, medium, or long neck. More specifically, as shown in FIG. 2, the pillow is oriented to provide a distance $d_2$ between the lower boundary of the aperture 20 and the lower peripheral edge 22 of the pillow. Conversely, if the pillow were rotated 180 degrees relative to the user 18, a section of the pillow of a length or distance $d_1$ would be positioned under the user's neck. As shown in FIG. 2, $d_1$ is much greater than $d_2$ and thus would be used by an individual with a longer neck than the individual shown in FIG. 2. Similarily, by rotating or orienting the pillow to other variations, further variations between the minimum distance $d_2$ and the maximum distance $d_1$ are obtained.

For added comfort, the outer surface 32 of the body is tapered or beveled outwardly moving from the upper surface 12 toward the lower surface 14. In other words, the radius of the pillow from center 28 is smallest adjacent the upper surface 12 and largest adjacent the lower surface 14. This tapered periphery 32, although not required, provides added comfort because it more closely fits the contour of a user's lower neck and upper shoulder region.

Also, as can be best seen in FIG. 2, in vertical cross section the illustrated pillow is generally trapezoidal in shape. In addition, as also shown in this figure, the aperture 20 can be described as having an inverted trapezoidal vertical cross section. Moreover, upper surface 12 is generally parallel to and spaced from the lower surface 14. The height of the pillow "h", see FIG. 2, is preferably within the range of one to two inches and more specifically from one and three-eights to one and three-fourths inches. A pillow which is much higher than this would tend to raise the head out of its fully retruded position in relation to the long axis of the body. In contrast, a pillow that is much shorter than this would concentrate the weight of the user's head over a smaller area, resulting in potential discomfort to the user.

With reference to FIGS. 3 and 4, an alternate embodiment of a pillow in accordance with the present invention is illustrated. For convenience, elements of FIGS. 3 and 4 which correspond to those of FIGS. 1 and 2 are numbered with the same numbers and will not be discussed in detail.

The body 10 of the FIGS. 3 and 4 pillow is also of a resilient material. However, in this case, the body is of a generally elliptical or oval shape and the aperture 20 is of a corresponding shape. Again, the aperture 20 is eccentrically oriented in the body so that, depending upon the orientation of the pillow relative to a user's head and neck, varying distances (such as $d_3$ and $d_4$) of pillow material can be positioned under the user's neck.

FIGS. 3 and 4 also disclose a means for adjusting the dimension of the aperture 20. Such a means may also be included in the embodiment of FIG. 1 if desired. The illustrated aperture adjustment mechanism comprises a slit 40 extending from the outer peripheral edge 22 of the body to the aperture 20. As shown in FIG. 4, slit 40 is bounded on one side by a slit bounding wall 42 and at its other side by another slit bounding wall 44. By respectively shifting walls 42, 44 toward or away from one another, the dimension of aperture 20 is made smaller or larger to fit the user's head more closely. A retaining or holding mechanism is provided for retaining or holding the walls 42, 44 in their desired position of adjustment. Although this retaining mechanism may take other forms, the illustrated form includes a first patch of hook and eye fabric 46 mounted to the surface 14 adjacent slit bounding wall 42 and another such patch 48 mounted to surface 14 adjacent to the wall 44. A spreader 50, which may be of a rigid material, such as plastic, in the form of a thin elongated bar, has an upper surface to which hook and eye fabric 52 is adhesively or otherwise mounted. By pressing bar 50 and fabric 52 against the patches 46, 48, the bar holds the walls 42, 44 and thus the aperture 20 in the desired position of adjustment. It should be noted that, in practice, the bar 50 is substantially against the surface 14 during use. However, for purposes of illustration, the bar is shown spaced somewhat from the surface 14.

A pillow in accordance with the present invention may be cut from a block or piece of synthetic foam material utilizing a jig. In this case, no assembly or molding would be required. Alternately, a pillow of the desired configuration and shape may be molded in a conventional manner using a self-skinning polyurethane material. In addition, a pillow in accordance with the present invention can be covered with a pillowcase without changing the essential character or functioning of the aperture. That is, the thin layers of cloth or material that would cover the aperture in this case would not significantly interfere with the orthopedic benefits available from a pillow in accordance with the present invention. Likewise, if the aperture is in the form of a depression that does not pass through to surface 14, the pillow will still function so long as the back of the user's head is not elevated significantly above the mattress surface. Typically, it is desired to have the head flush with or within approximately one-half inch of the plane containing the mattress.

Having illustrated and described the principles of my invention with reference to several preferred embodiments, it should be apparent to those persons skilled in the art that such invention may be modified in arrangement and detail without departing from such principles. I claim as my invention all such modifications as come within the true spirit and scope of the following claims.

1. An orthopedic head pillow for supporting a user's head while the user is supported by a mattress or other support surface comprising:

a body of a resilient material;

the body having an upper surface and a base surface for resting on the support surface;

the body having a peripheral edge or boundary and an interior wall surface defining a generally hemispherical head receiving aperture spaced from the peripheral edge and extending through the body between the upper and base surfaces, the aperture permitting the back of the user's head to rest substantially in the plane of the support surface with the wall surfaces supporting the sides of the user's head when the user is lying on the support surface and the user's head is positioned within the aperture;

the aperture being positioned at a location within the body so as to provide differing distances from plural locations along the peripheral edge to the aperture, whereby a user may orient the pillow to select the distance between the peripheral edge and aperture which conforms to the length of the user's neck; and the body having a generally circular periphery with a center and the aperture having a center which is spaced from the center of the body.

2. An orthopedic head pillow according to claim 1 in which the body has first and second slit bounding walls which bound a slit extending from a location at the periphery of the body to the aperture, the spacing between the first and second slit bounding walls being adjustable to vary the width of the slit and thereby the size of the aperture, such slit bounding walls being spread further apart to increase the size of the aperture and moved closer together to decrease the size of the aperture, the pillow also including aperture size retaining means for selectively holding the slit bounding walls in the position to which they are adjusted.

3. An orthopedic pillow according to claim 1 in which the upper and base surfaces are generally planar and the body is tapered outwardly from the upper surface to the base surface at the periphery.

4. An orthodedic pillow according to claim 1 in which the distance between the upper and base surfaces is in the range of from one inch to two inches.

5. An orthopedic pillow according to claim 1 in which the distance between the upper and base surfaces is in the range of from one and three-eights inches to one and three-fourths inches.

6. An orthopedic head pillow for supporting a user's head while the user is supported by a mattress or other support surface comprising:

a body of a resilient material;

the body having an upper surface and a base surface for resting on the support surface;

the body having a peripheral edge or boundary and an interior wall surface defining a generally hemispherical head receiving aperture spaced from the peripheral edge and extending through the body between the upper and base surfaces, the aperture permitting the back of the user's head to rest substantially in the plane of the support surface with the wall surfaces supporting the sides of the user's head when the user is lying on the support surface and the user's head is positioned within the aperture;

the aperture being positioned at a location within the body so as to provide differing distances from plural locations along the peripheral edge to the aperture, whereby a user may orient the pillow to select the distance between the peripheral edge and aperture which conforms to the length of the user's neck; and the body having a generally elliptical periphery and the aperture being positioned at a location spaced from the center of the body.

7. An orthopedic head pillow for supporting a user's head while the user is supported by a mattress or other support surface comprising:

a body of a resilient material;

the body having an upper surface and a base surface for resting on the support surface;

the body having a peripheral edge or boundary and an interior wall surface defining a generally hemispherical head receiving aperture spaced from the peripheral edge and extending through the body between the upper and base surfaces, the aperture permitting the back of the user's head to rest substantially in the plane of the support surface with the wall surfaces supporting the sides of the user's head when the user is lying on the support surface and the user's head is positioned within the aperture;

the aperture being positioned at a location within the body so as to provide differing distances from plural locations along the peripheral edge to the aperture, whereby a user may orient the pillow to select the distance between the peripheral edge and aperture which conforms to the length of the user's neck;

the body having first and second slit bounding walls which bound a slit extending from a location at the periphery of the body to the aperture, the spacing between the first and second slit bounding walls being adjustable to vary the width of the slit and thereby the size of the aperture, such slit bounding walls being spread further apart to increase the size of the aperture and moved closer together to decrease the size of the aperture, the pillow also including aperture size retaining means for selectively holding the slit bounding walls in a position to which they are adjusted; and the aperture size retaining means comprising a first hook and eye fabric patch mounted to the base surface adjacent the first slit bounding wall, a second hook and eye fabric patch mounted to the base surface adjacent the second slit bounding wall, a slit spreader means having hook and eye fabric on an upper surface thereof for cooperatively engaging the first and second patches to selectively hold the slit bounding walls in the position to which they are adjusted.

8. An orthopedic head pillow for supporting a user's head while the user is supported by a mattress or other support surface comprising:

a body of a resilient material;

the body having an upper surface and a base surface for resting on the support surface;

the body having a peripheral edge or boundary and an interior wall surface defining a generally hemispherical head receiving aperture spaced from the peripheral edge and extending through the body between the upper and base surfaces, the aperture permitting the back of the user's head to rest substantially in the plane of the support surface with the wall surfaces supporting the sides of the user's head when the user is lying on the support surface and the user's head is positioned within the aperture;

the upper and base surfaces being generally planar and the body being tapered outwardly from the upper surface to the base surface at the periphery; and the body having a vertical section which is generally trapezoidal.

9. An orthopedic pillow according to claim 8 in which the aperture has a vertical section which is generally an inverted trapezoid.

10. An orthopedic head pillow for supporting a user's head while the user is supported by a mattress or other support surface comprising:

a body of a resilient material;

the body having an upper surface and a base surface for resting on the support surface;

the body having a peripheral edge or boundary and an interior wall surface defining a head receiving depression spaced from the peripheral edge and permitting the back of the user's head to rest substantially in the plane of the support surface with the wall surfaces supporting the sides of the user's head when the user is lying on the support surface and the user's head is positioned within the aperture;

the depression being positioned at a location within the body so as to provide differing distances from plural locations along the peripheral edge to the aperture, whereby a user may orient the pillow to select the distance between the peripheral edge and depression which conforms to the length of the user's neck;

the depression comprising an aperture extending between the upper and base surfaces, the body also having first and second slit bounding walls which bound a slit extending from a location at the periphery of the body to the aperture, the spacing between the first and second slit bounding walls being adjustable to vary the width of the slit and thereby the size of the aperture, such slit bounding walls being spread further apart to increase the size of the aperture and moved closer together to decrease the size of the aperture, the pillow also including aperture size retaining means for selectively holding the slit bounding walls in the position to which they are adjusted; and the aperture size retaining means comprising a first hook and eye fabric patch mounted to the base surface adjacent the first slit bounding wall, a second hook and eye fabric patch mounted to the base surface adjacent the second slit bounding wall, a slit spreader means having hook and eye fabric on an upper surface thereof for cooperatively engaging the first and second patches to selectively hold the slit bounding walls in the position to which they are adjusted.

11. An orthopedic head pillow for supporting a user's head while the user is supported by a mattress or other support surface comprising:

a body of a resilient material;

the body having an upper surface and a base surface for resting on the support surface;

the body having a peripheral edge or boundary and an the body having a peripheral edge or boundary and an interior wall surface defining a head receiving depression spaced from the peripheral edge and permitting the back of the user's head to rest substantially in the plane of the support surface with the wall surfaces supporting the sides of the user's head when the user is lying on the support surface and the user's head is positioned within the aperture;

the depression being positioned at a location within the body so as to provide differing distances from plural locations along the peripheral edge to the aperture, whereby a user may orient the pillow to select the distance between the peripheral edge and depression which conforms to the length of the user's neck; and the upper and base surfaces being generally planar and the body being tapered outwardly from the upper surface to the base surface at the periphery, the body having a vertical section which is generally trapezoidal, and the aperture having a vertical section which is generally an inverted trapezoid.

12. An orthopedic head pillow according to claim 11 in which the depression comprises an aperture extending between the upper and base surfaces, the body also having first and second slit bounding walls which bound a slit extending from a location at the periphery of the body to the aperture, the spacing between the first and second slit bounding walls being adjustable to vary the width of the slit and thereby the size of the aperture, such slit bounding walls being spread further apart to increase the size of the aperture and moved closer together to decrease the size of the aperture, the pillow also including aperture size retaining means for selectively holding the slit bounding walls in the position to which they are adjusted, the aperture size retaining means comprising a first hook and eye fabric patch mounted to the base surface adjacent the first slit bounding wall, a second hook and eye fabric patch mounted to the base surface adjacent the second slit bounding wall, a slit spreader means having hook and eye fabric on an upper surface thereof for cooperatively engaging the first and second patches to selectively hold the slit bounding walls in the position to which they are adjusted.

* * * * *

UNITED STATES PATENT AND TRADEMARK OFFICE

CERTIFICATE OF CORRECTION

PATENT NO. : 4,768,246

DATED : September 6, 1988

INVENTOR(S) : John D. Summer

It is certified that error appears in the above-identified patent and that said Letters Patent is hereby corrected as shown below:

In the Specification:

Column 5, Line 3: "eights" should be --eighths--; and

Column 5, Line 19: "correspending" should be --corresponding--.

In the Claims:

Column 6, Line 54 (Claim 4): "orthodedic" should be --orthopedic--;

Column 6, Line 59 (Claim 5): "three-eights" should be --three-eighths--; and

Column 9, Lines 9-10 (Claim 11): Delete "the body having a peripheral edge or boundary and an".

Signed and Sealed this

Twenty-first Day of February, 1989

*Attest:*

DONALD J. QUIGG

*Attesting Officer*

*Commissioner of Patents and Trademarks*